US008622500B2

(12) United States Patent
Kagata et al.

(10) Patent No.: US 8,622,500 B2
(45) Date of Patent: Jan. 7, 2014

(54) RECORDING DEVICE, METHOD FOR CONTROLLING RECORDING DEVICE, AND OPERATION CONTROL PROGRAM

(75) Inventors: Takayoshi Kagata, Shiojiri (JP); Tsuyoshi Sano, Shiojiri (JP)

(73) Assignee: Seiko Epson Corporation (JP)

( * ) Notice: Subject to any disclaimer, the term of this patent is extended or adjusted under 35 U.S.C. 154(b) by 696 days.

(21) Appl. No.: 12/508,738

(22) Filed: Jul. 24, 2009

(65) Prior Publication Data

US 2010/0026749 A1 Feb. 4, 2010

(30) Foreign Application Priority Data

Jul. 31, 2008 (JP) ..... 2008-197486

(51) Int. Cl.
*B41J 29/38* (2006.01)

(52) U.S. Cl.
USPC ..... 347/14; 347/5; 347/6; 347/7; 347/21; 347/22; 347/23; 347/28

(58) Field of Classification Search
USPC ..... 347/5–7, 14, 21–23, 28–36
See application file for complete search history.

(56) References Cited

U.S. PATENT DOCUMENTS

| | | | | |
|---|---|---|---|---|
| 4,050,078 | A * | 9/1977 | Isayama et al. | 347/7 |
| 5,917,512 | A * | 6/1999 | Weber et al. | 347/28 |
| 6,364,448 | B2 * | 4/2002 | Nishioka et al. | 347/23 |
| 7,510,261 | B2 * | 3/2009 | Karppinen et al. | 347/23 |
| 2003/0043221 | A1 * | 3/2003 | Vega et al. | 347/19 |
| 2007/0035573 | A1 * | 2/2007 | Hoshi | 347/22 |
| 2007/0080983 | A1 * | 4/2007 | Karppinen et al. | 347/22 |
| 2007/0080985 | A1 * | 4/2007 | Karppinen et al. | 347/28 |
| 2008/0192074 | A1 * | 8/2008 | Dubois et al. | 347/5 |
| 2009/0115815 | A1 * | 5/2009 | Uda et al. | 347/28 |
| 2009/0153614 | A1 * | 6/2009 | Karppinen et al. | 347/28 |

FOREIGN PATENT DOCUMENTS

| | | |
|---|---|---|
| JP | 2001-334684 | 12/2001 |
| JP | 2002-240311 | 8/2002 |
| JP | 2003-220798 | 8/2003 |
| JP | 2006-240164 | 9/2006 |
| JP | 2007 -296651 | 11/2007 |

OTHER PUBLICATIONS

English Patent Abstract of Japan 2006-240164 Published Sep. 14, 2006.
English Patent Abstract of Japan 2007-296651 Published Nov. 15, 2007.

(Continued)

*Primary Examiner* — Ryan Lepisto
*Assistant Examiner* — Guy Anderson
(74) *Attorney, Agent, or Firm* — Harness, Dickey & Pierce, P.L.C.

(57) ABSTRACT

A recording device forming a printed image by discharging droplets of an image forming solution from a nozzle and attaching the droplets on recording media, which includes a recording head provided with a specific nozzle which is selectively filled with the image forming solution and a solution preventing the nozzle from being clogged, and a controller that controls the performance of switching from a first filled state in which the specific nozzle is filled with the image forming solution to a second filled state in which the specific nozzle is filled with the solution preventing the nozzle from clogging in accordance with a predetermined condition.

24 Claims, 4 Drawing Sheets

(56) References Cited

OTHER PUBLICATIONS

Computer-Generated Translation of Japanese 2003-220798 Published Aug. 5, 2003.

Computer-Generated Translation of Japanese 2001-334684 Published Dec. 4, 2001.

Computer-Generated Translation of Japanese 2002-240311 Published Aug. 28, 2002.

* cited by examiner

RECORDING DEVICE, METHOD FOR CONTROLLING RECORDING DEVICE, AND OPERATION CONTROL PROGRAM

BACKGROUND

1. Technical Field

The present invention relates to a recording device forming a printed image by attaching a droplet on recording media, a method for controlling a recording device, and an operation control program.

2. Related Art

There is a well known ink jet printer which carries out printing on various media such as paper, fabrics, films, and the like by discharging droplets of ink. Such an ink jet printer prints an image by discharging droplets of each colored ink such as cyan (C), magenta (M), yellow (Y), black (K), and the like from a nozzle, thereby forming dots on media.

In recent years, various inks have been developed, for example, among black inks, photo black ink, which is capable of producing a record having high glossy effect on glossy paper and suitable for a photo image; matte black ink which is suitable for matte paper having no gloss effect; and the like.

In JP-A-2006-240164, an ink replacement system which makes it possible to discharge plural kinds of ink using one nozzle row and if necessary, replaces inks discharged from one nozzle row is described. According to such a system, it is possible to selectively discharge either the photo black ink or the matte black ink.

However, when the ink jet printer is configured to discharge plural kinds of ink using one nozzle row, residual ink and the replacement ink may become mixed. In JP-A-2007-296651, an ink supply system is described which prevents ink mixing due to the ink replacement by providing a cleaning solution is described.

There are inks used for purposes other than forming an image. For example, as for transparent media, even though only an image is directly printed thereon, a neutral color having high brightness such as gray or the like except for a high density color such as red, blue, yellow, black, or the like in the image is not accurately displayed because it is interfered with by light transmitted through the transparent media to the image. Therefore, there have been various proposals for printing in which a background color layer is provided on transparent media and an image such as a color image, or the like is printed thereon. For example, a white ink may be used for printing the background color layer.

However, when a nozzle row filled with ink is left uncontrolled over a long time in such an ink jet printer, the nozzle may become clogged because of the ink adhered thereto, or the like, and droplets of the ink may not be normally discharged. In such a case, since the printer can not accurately form dots on recording media, it is impossible to produce fine prints. In order to prevent the nozzle from being clogged, a so-called flushing operation and cleaning operation are generally carried out.

However, since the frequency and degree of clogging in each nozzle row are different according to the kind of ink, there may be a nozzle row in which clogging is not dissolved even though a cleaning operation is carried out. For example, pigment-based white ink has particles bigger than that of the other pigment-based inks such as cyan (c), magenta (M), yellow (Y), and the like, and readily clogs a nozzle. When the particles are big, the degree of clogging rapidly becomes worse even in the early stage of the clogging and it may be impossible to dissolve the clogging only by simply repeating the cleaning operation. Therefore, it is necessary to prevent a nozzle from being left uncontrolled over a long time while the nozzle is filled with ink.

SUMMARY

An advantage of some aspects of the present invention is to solve the above-mentioned problems and to provide a recording device capable of preventing a specific nozzle from being left uncontrolled over a long time while the nozzle is filled with ink causing clogging, a method for controlling a recording device, and an operation control program. In addition, an advantage of some aspects of the present invention is to provide a recording device capable of avoiding circumstances which may cause nozzle clogging before they happen and decreasing the number of times for cleaning, a method for controlling a recording device, and an operation control program.

According to an aspect of the invention capable of solving the above-mentioned problems, there is provided a recording device forming a printed image by discharging droplets of an image forming solution from a nozzle and attaching the droplets to recording media, which includes a recording head provided with a specific nozzle which is selectively filled with the image forming solution and a solution preventing the nozzle from being clogged, and a controller that controls the performance of switching from a first filled state in which the specific nozzle is filled with the image forming solution to a second filled state in which the specific nozzle is filled with the solution preventing the nozzle from clogging in accordance with a predetermined condition.

According to the above aspect of the invention, a specific nozzle is selectively filled with an image forming solution forming a printed image and a solution preventing clogging in accordance with a predetermined condition. Accordingly, in the case that a process for forming a printed image is not carried out over a long time, the specific nozzle is not clogged when it is switched to fill the specific nozzle with the solution preventing clogging. Therefore, it is possible to prevent the specific nozzle from being left uncontrolled over a long time while the nozzle is filled with ink causing clogging.

According to the known methods, when white ink, which has bigger particles than that of multicolored ink and readily causes clogging, is filled as an image forming solution, it is necessary to replace the ink in the ink flow path by cleaning in order to prevent the nozzle from clogging and to secure the ink discharging stability. According to the above aspect of the invention, it is possible to avoid circumstances which may cause nozzle clogging before they happen by switching to the second filled state. Therefore, it is possible to provide a recording device capable of reducing the burdens on the environment because the number of times cleaning must be carried out is decreased and the amount of wasted ink is decreased in the device.

In accordance with the recording device according to the above aspect of the invention, the predetermined condition indicates a case where the controller determines that the duration of the first filled state is equal to or longer than the preset time.

In this case, as a time when the specific nozzle is clogged, an empirically obtained value can be preset. When the set time is compared to the actual duration, the period for switching to the second filled state can be set to the minimum within the range capable of preventing the clogging. Accordingly, it is possible to avoid unnecessarily expending the solution preventing the clogging.

In accordance with the recording device according to the above aspect of the invention, the predetermined condition indicates a case where it is detected that there is a nozzle failure by a discharging test from the nozzle when the duration of the first filled state is shorter than the preset time.

In this case, when there is a nozzle failure even though the duration of the first filled state is shorter than the preset time, it is possible to switch to the second filled state. Accordingly, without only depending on an empirically obtained value set as the time when the specific nozzle is clogged, when it is detected that there is a nozzle failure, the specific nozzle is filled with a solution preventing clogging. Therefore, it is possible to prevent the nozzle from further being clogged.

In accordance with the recording device according to the above aspect of the invention, the predetermined condition indicates a case where the controller determines that the scheduled power OFF duration is equal to or longer than the preset time when the scheduled power OFF duration is input after a command to cut OFF the power of the recording device is made.

In this case, even when a command to cut OFF the power is made, it is possible to switch the first filled state to the second filled state before executing the power OFF process. That is, while the power is OFF, it is possible to fill a specific nozzle with a solution preventing clogging. Accordingly, it is possible to prevent the specific nozzle from being left uncontrolled over a long time while the nozzle is filled with ink causing clogging.

The recording device according to the above aspect of the invention includes a switch which automatically switches the first filled state to the second filled state in accordance with a command from the controller when the predetermined condition is satisfied.

In this case, since the switch automatically switches the first filled state to the second filled state, a user does not need to switch the state by hand. Therefore, even when the user is not near the recording device, the specific nozzle is automatically filled with a solution preventing clogging.

The recording device according to the above aspect of the invention includes a carriage in which a receptor which contains the image forming solution and another receptor which contains the solution preventing clogging are loaded, and a notifier which notifies to switch the receptor to another receptor in accordance with a command from the controller when the predetermined condition is satisfied.

In this case, the notifier notifies to switch the receptor which contains the image forming solution to another receptor which contains the solution preventing clogging. Accordingly, in an ink jet printer using a so-called on-carriage type ink cartridge, a user can replace an ink cartridge with a cartridge in which a solution preventing clogging is contained in accordance with a notice.

According to a second aspect of the invention capable of solving the above-mentioned problems, there is provided a method for controlling a recording device, which includes a recording head provided with a specific nozzle which is selectively filled with an image forming solution and a solution preventing the nozzle from being clogged and forms a printed image by attaching droplets of the image forming solution on recording media, which includes deciding whether or not a predetermined condition is satisfied; and when the predetermined condition is satisfied, switching from a first filled state in which the specific nozzle is filled with the image forming solution to a second filled state in which the specific nozzle is filled with the solution preventing the nozzle from clogging.

According to the above aspect of the invention, it is possible to prevent the specific nozzle from being left uncontrolled over a long time while the nozzle is filled with ink causing clogging. Therefore, it is possible to prevent ink clogging.

According to a third aspect of the invention capable of solving the above-mentioned problems, there is provided an operation control program, which executes a decision as to whether or not a predetermined condition is satisfied, and when the predetermined condition is satisfied, switching from a first filled state in which the specific nozzle is filled with the image forming solution to a second filled state in which the specific nozzle is filled with the solution preventing the nozzle from being clogged, in a computer equipped with a recording device which includes a recording head provided with a specific nozzle which is selectively filled with an image forming solution and a solution preventing the nozzle from being clogged and forms a printed image by attaching droplets of the image forming solution on recording media.

According to the above aspect of the invention, simply by loading the operation control program in the recording device, it is possible to prevent the specific nozzle from being left uncontrolled over a long time while the nozzle is filled with ink causing clogging. Therefore, it is possible to prevent ink clogging.

BRIEF DESCRIPTION OF THE DRAWINGS

FIG. 3 is a flow chart representing a flow of a switching process executed when the power of a printer according to an embodiment of the invention is ON.

DESCRIPTION OF EXEMPLARY EMBODIMENTS

Figure 1:
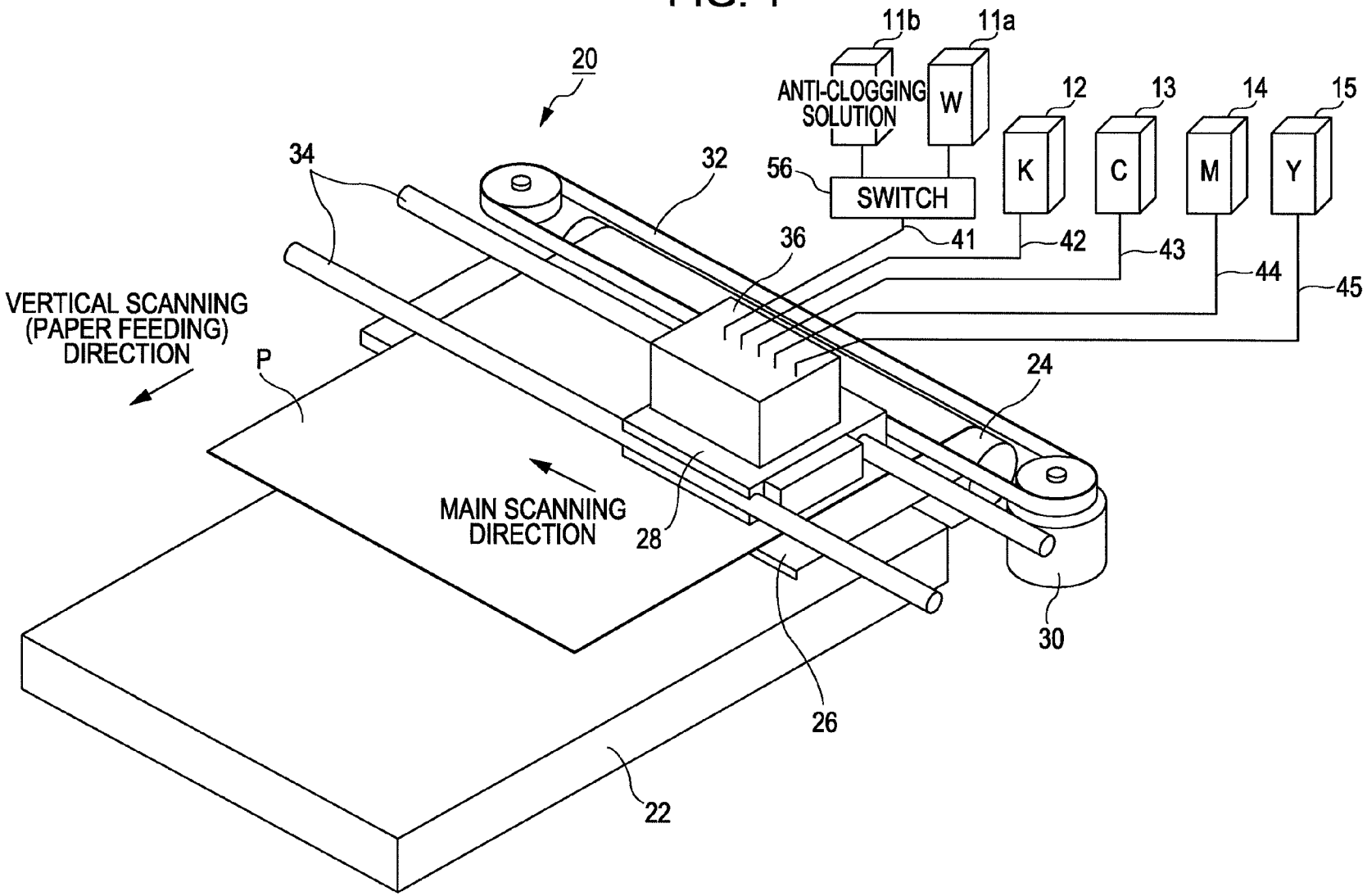
FIG. 1 is a schematic perspective view illustrating a main configuration section of a printer according to an embodiment of the invention.
Figure 2:
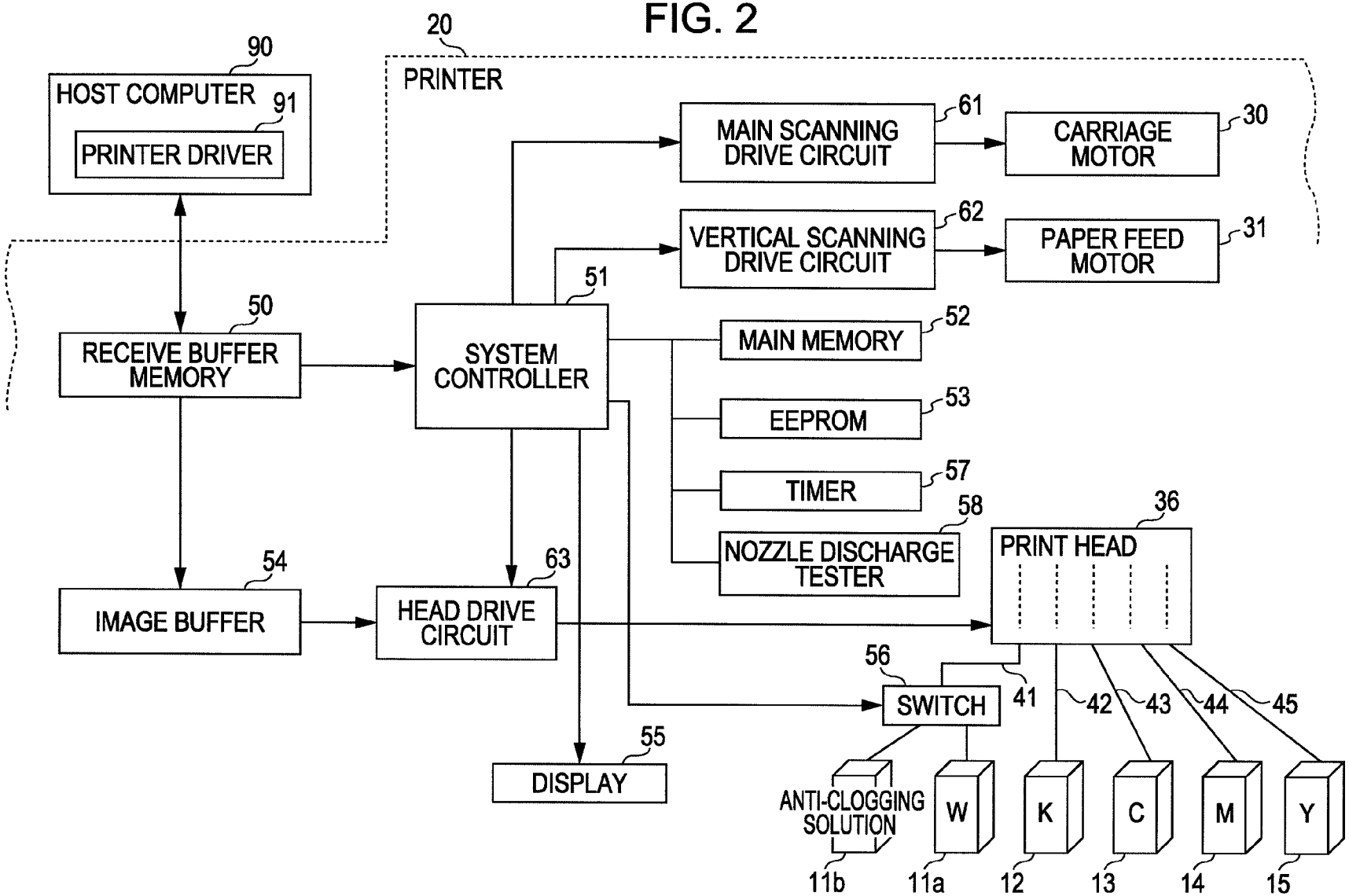
FIG. 2 is a block diagram illustrating an electric configuration of the printer shown in FIG. 1.

Preferred embodiments of a recording device according to the invention will be described in detail below with reference to the drawings. In addition, an ink jet printer (hereinafter, referred to as 'printer') will be described as an example for the recording device. FIG. 1 is a schematic perspective view illustrating a main configuration section of a printer according to this embodiment and FIG. 2 is a block diagram illustrating an electric configuration of the printer shown in FIG. 1.

A printer 20 shown in FIG. 1 is equipped with a paper stacker 22, a paper feed roller 24 driven by a step motor not shown in the drawing, a platen 26, a carriage 28, a carriage motor 30, a drawing belt 32 driven by the carriage motor 30, and a guide rail 34 which guides the scanning of the carriage 28. A print head (recording head) 36 which includes a lot of nozzles is loaded in the carriage 28.

The print head 36 is connected to each of cartridges 11*a*, 11*b*, 12, 13, 14, and 15 through liquid supply paths 41, 42, 43, 44, and 45. The cartridge 12 contains black ink (K), the cartridge 13 contains cyan ink (C), the cartridge 14 contains magenta ink (M), and the cartridge 15 contains yellow ink (Y). According to this embodiment, the cartridge 11*a* contains white ink (W) and the cartridge 11*b* contains an anti-clogging solution. The anti-clogging solution is filled in a nozzle row discharging white ink among the nozzle rows included in the print head 36. That is, the nozzle row discharging white ink is selectively filled with white ink and an anti-clogging solution via a switch 56.

Each cartridge includes an ink pack which contains each ink (image forming solution) or a liquid-containing pack which contains an anti-clogging solution and an air chamber is formed around the ink pack or the liquid-containing pack. When a pressure is applied to the air chamber by a pressure unit not shown in the drawing, each ink in the ink pack or the anti-clogging solution in the liquid-containing pack is supplied to the print head 36 through the liquid supply paths 41, 42, 43, 44, and 45. As mentioned above, the printer 20 of this embodiment is not a so-called on-carriage type printer in which an ink cartridge is loaded on the carriage 28 but is an off-carriage type ink jet printer in which an ink cartridge is statically mounted on a predetermined position in a main body of the printer 20.

Printing paper (recording medium) P in the paper stacker 22 is wound on the paper feed roller 24 and transported through the surface of the platen 26 in a vertical scanning direction perpendicular to a main scanning direction of the print head. The carriage 28 is drawn by the drawing belt 32 driven by the carriage motor 30 and moves through the guide rail 34 in a main scanning direction.

As shown in FIG. 2, the printer 20 includes a receive buffer memory 50 receiving a signal transmitted from a host computer 90, an image buffer 54 storing image data, a system controller (controller) 51 controlling all the operations in the printer 20, a main memory 52, and an EEPROM 53. When the main memory 52 reads and runs firmware stored in the EEPROM 53, various operations of the printer 20 are carried out.

The system controller 51 is connected to a main scanning drive circuit 61 driving the carriage motor 30, a vertical scanning drive circuit 62 driving a paper feed motor 31, and head drive circuit 63 driving the print head 36. A paper feed mechanism is provided with the vertical scanning drive circuit 62, the paper feed motor 31, and the paper feed roller 24.

The system controller 51 controls the main scanning drive circuit 61 and the vertical scanning drive circuit 62 in accordance with various commands contained in print data received by the receive buffer memory 50, a setting condition preliminarily written in the EEPROM 53, and the like.

For example, when the printer is set to print high definition images, printing is carried out according to a so-called interless method, which includes printing images by intermittently forming a raster in the main scanning direction, by controlling the main scanning drive circuit 61 and the vertical scanning drive circuit 62. In addition, printing may be carried out according to a so-called overlap method which includes printing images by intermittently driving a nozzle forming a raster.

In addition, the system controller 51 is connected to a display 55, a switch 56, a timer 57, and a nozzle discharge tester 58. The display 55 displays content to be displayed on a liquid crystal display screen of the printer 20. Otherwise, content to be displayed is transmitted to a printer driver 91 of a host computer 90, thereby displaying on a display screen 91 of the driver. The switch 56 is similar to a switching valve and automatically switches a liquid supplied to the liquid supply path 41 to either the white ink or the anti-clogging solution in accordance with a command from the system controller 51. The timer 57 checks a period of duration of a state (first filled state) where a discharging operation does not occur while a specific nozzle row in the print head 36 is filled with white ink, that is, an uncontrolled period.

The nozzle discharge tester 58 is disposed in a non-printable area outside a printable area by the print head 36 on the carriage 28. When the carriage 28 moves from the printable area to the non-printable area in a main scanning direction, it enters a state in which a discharging state test is carried out. The nozzle discharge tester 58 according to this embodiment is disposed on the lower side of the print head 36 so as to face each nozzle row in the print head 36 which has been moved to a non-printable area. In addition, the nozzle discharge tester 58 is composed of a conductive ink absorber for absorbing droplets of ink discharged from each of the nozzle rows in the print head 36, a detecting section that detects an induced current generated in the conductive ink absorber when charged droplets of ink approach the absorber, a voltage applying section that applies a voltage to the conductive ink absorber so as to charge droplets of ink when the droplets of ink are discharged from each of the nozzle rows, and a container having a bottom which contains the conductive ink absorber.

When the charged droplets of ink are discharged from each of the nozzle rows toward the conductive ink absorber, an induced current is generated in the conductive ink absorber because an electrostatic induction phenomenon and the like occur in accordance with the approach of the droplets of ink. That is, in accordance with the approach of the droplets of ink, an induced current flows in the conductive ink absorber so as to induce an electric charge having a polarity opposite to that of the droplets of ink.

A method for switching white ink to an anti-clogging solution in the printer 20 according to this embodiment configured as mentioned above will be described.

The system controller 51 controls the performance of switching from a first filled state in which a specific nozzle row, which is selectively filled with white ink and an anti-clogging solution, is filled with white ink to a second filled state in which the specific nozzle row is filled with the anti-clogging solution in accordance with a predetermined condition. A switching process executed when the power of the printer 20 is ON and a switching process executed when the power of the printer 20 is OFF will be described below.

Figure 3:
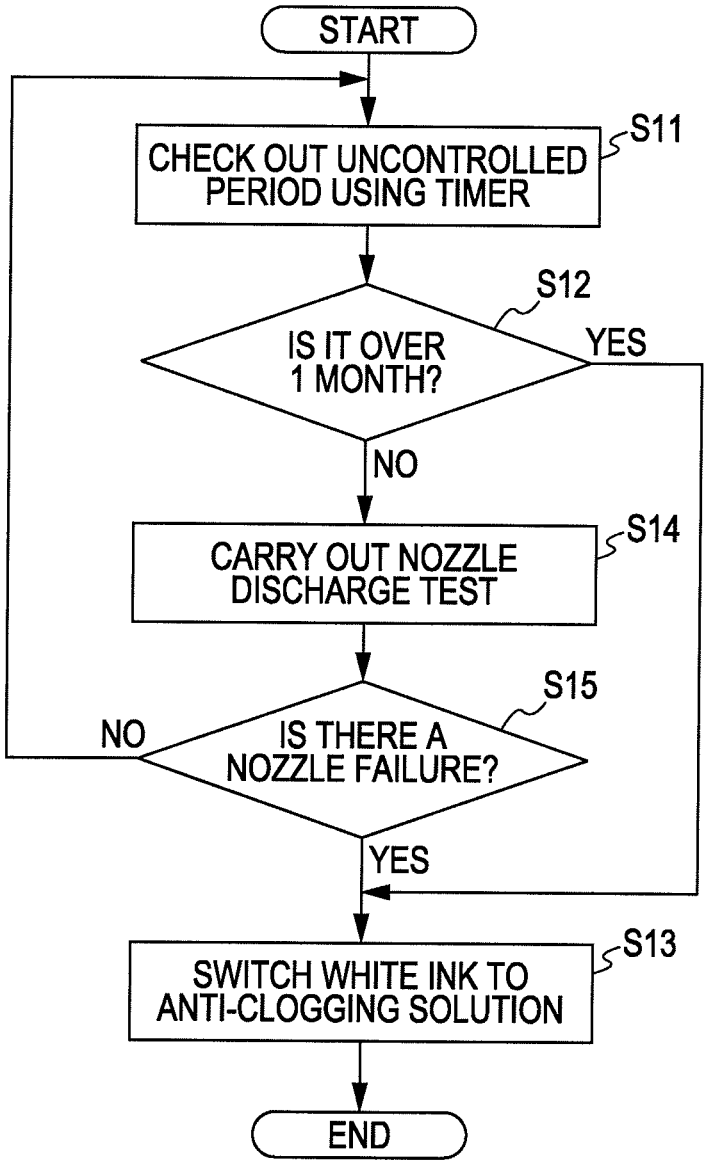

FIG. 3 is a flow chart representing a flow of a switching process executed when the power of a printer is ON. When the power of the printer 20 is ON, the system controller 51 commands the timer 57 to check the duration of a state where a specific nozzle row discharging white ink among the nozzle rows in the print head 36 is filled with white ink, that is, a period in which the printer 20 is uncontrolled. In addition, when a discharging operation from the nozzle row in the print head 36 is carried out within the preset time, the timer 57 is reset and resumes timing.

In this embodiment, the preset time is one month. one month is an empirically obtained value as the maximum period that a nozzle row will stay unclogged when the nozzle row is uncontrolled while it is filled with white ink. Accordingly, the value is varied according to the installation environment of the printer 20, an ink composition of the white ink, or the like, and may be appropriately changed by a command or the like. Herein, it is described on the assumption that pigment-based white ink is applied. In general, a particle size (for example, around 600 nm) of a pigment of the white ink is bigger than a particle size of (for example, around 100 nm) a pigment contained in background colored ink so that the white ink readily causes clogging. When a particle size of ink is big, a degree of a clogging rapidly becomes worse even in the early stage of the clogging and it may be impossible to dissolve the clogging only by simply performing the cleaning operation.

On the other hand, when the above-mentioned period is set too short to absolutely prevent clogging, an anti-clogging solution is filled in the nozzle row at short intervals. Therefore, a large amount of the anti-clogging solution is expended, thereby deteriorating cost performance. For that reason, in this embodiment, the period is set as one month, which is the empirically obtained value as the maximum period that the nozzle row will remain unclogged.

The system controller 51 checks out the uncontrolled period checked by the timer 57 (step S11). The controller determines whether or not the uncontrolled period is over one month. When it is decided that the uncontrolled period is over one month (step S12: Yes), the system controller 51 commands the switch 56 to shut a valve of a white ink side and to open a valve of an anti-clogging solution side. After that, the controller drives a pressure unit not shown in the drawing in the cartridge 11*b* to supply an anti-clogging solution to the print head 36 through the liquid supply path 41. The anti-clogging solution supplied to the print head 36 is filled in a nozzle row filled with white ink. That is, the white ink filled in the nozzle row at that time is extruded from the nozzle row by the anti-clogging solution, thereby switching to the anti-clogging solution (step S13).

Meanwhile, when it is decided that the uncontrolled period is shorter than one month in step S12 (step S12: No), the system controller 51 commands the nozzle discharge tester 58 to carry out a nozzle discharge test. The nozzle discharge tester 58 carries out the nozzle discharge test (step S14) and it is determined whether or not a nozzle failure has occurred in a nozzle row filled with white ink based on test results. When a nozzle failure is found in a nozzle row filled with white ink (step S15: Yes), white ink is switched to an anti-clogging solution (step S13). On the other hand, when a nozzle failure is not found in a nozzle row filled with white ink (step S15: No), the controller turns back to step S11 and resets the timer 57 to resume timing.

As mentioned above, according to this embodiment, a specific nozzle is selectively filled with white ink and an anti-clogging solution in accordance with a predetermined condition. Therefore, when it is switched so that a specific nozzle is to be filled with an anti-clogging solution, provided that an ink discharging operation is not carried out over a long time, the specific nozzle row is not clogged. Accordingly, it is possible to prevent the specific nozzle row from being left uncontrolled over a long time while the nozzle row is filled with white ink having a particle size bigger than that of multicolored ink and readily causing clogging.

When a time when the specific nozzle is clogged is preset as an empirically obtained value and the setting time of one month is compared to the actual uncontrolled period, it is possible to control the number of times for switching to the anti-clogging solution to the minimum within the range capable of preventing clogging. Accordingly, it is possible to prevent the anti-clogging solution from being unnecessarily expended.

When it is detected that there is a nozzle failure even though the uncontrolled period is shorter than the preset period of one month, it may be switched to an anti-clogging solution. Therefore, without solely depending on an empirically obtained period of one month as a time when a specific nozzle row is clogged, when it is detected that there is a nozzle failure, the specific nozzle row is filled with an anti-clogging solution. Therefore, it is possible to prevent the nozzle row from further being clogged.

Figure 4:
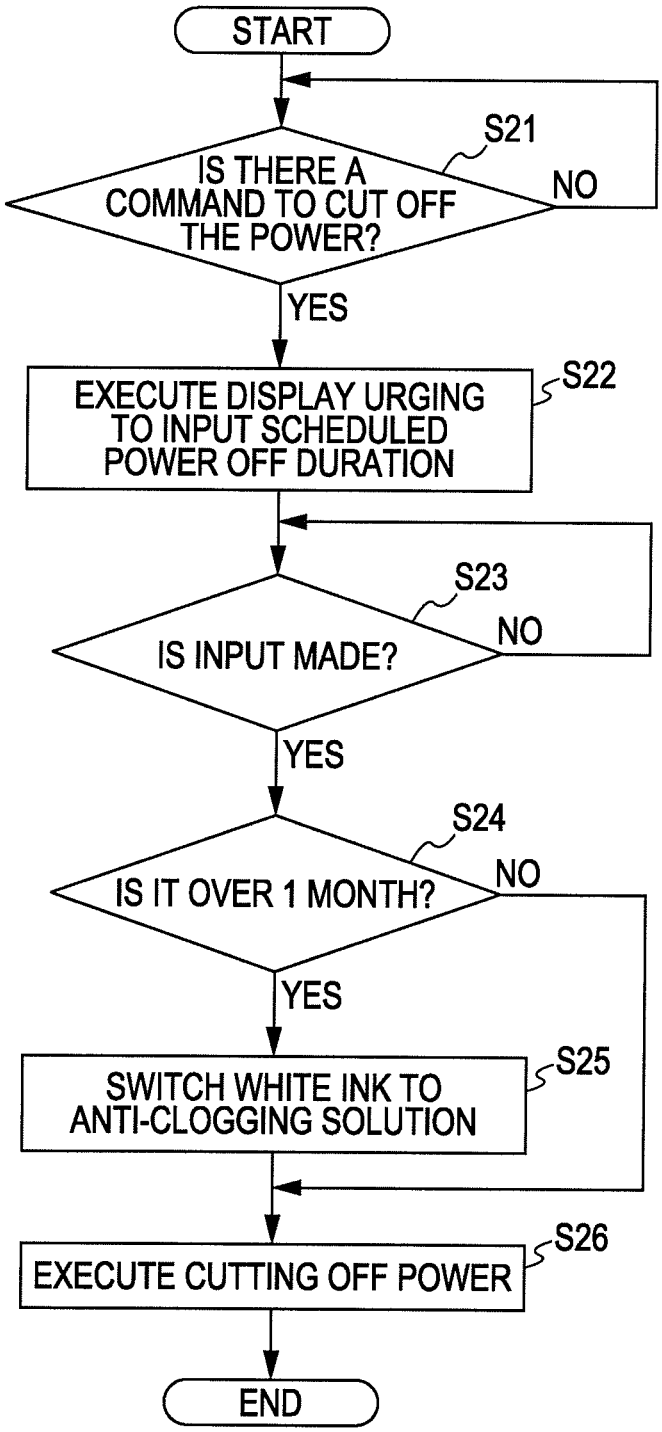
FIG. 4 is a flow chart representing a flow of a switching process executed before the power of a printer according to an embodiment of the invention is cut OFF.

FIG. 4 represents a switching process executed before the power of the printer 20 is cut OFF and is a flow chart representing a flow of a switching process executed before the power of a printer according to an embodiment of the invention is cut OFF.

When there is a command to cut OFF the power of the printer 20 from outside (step S21: Yes), the system controller 51 commands the printer driver 91 of the host computer 90 to display a message urging a user to input a scheduled power OFF duration (step S22). When the user reads a displayed message and inputs the scheduled power OFF duration, an input value is transmitted to the printer 20.

When the system controller 51 detects an input (step S23: Yes), the controller determines whether or not the scheduled power OFF duration transmitted from the printer driver 91 is over one month which is the preset period (step S24). When it is decided that the scheduled power OFF duration is over one month (step S24: Yes), the system controller 51 commands the switch 56 to shut a valve of a white ink side and to open a valve of an anti-clogging solution side. After that, the controller drives a pressure unit not shown in the drawing in the cartridge 11*b* to supply an anti-clogging solution to the print head 36 through the liquid supply path 41. The anti-clogging solution supplied to the print head 36 is filled in a nozzle row filled with white ink. That is, the white ink filled in the nozzle row by that time is extruded from the nozzle row by the anti-clogging solution, thereby switching to the anti-clogging solution. After that, a power OFF process is executed (step S25 and step S26).

On the other hand, when it is decided that the scheduled power OFF duration is shorter than one month in step S24 (step S24: No), a power OFF process is executed without switching the white ink to an anti-clogging solution (step S26).

As mentioned above, according to this embodiment, even when a command to cut OFF the power is made, it is possible to switch a state where a nozzle row is filled with white ink to a state where the nozzle row is filled with an anti-clogging solution before executing a power OFF process. That is, while the power is OFF, it is possible to fill a nozzle row filled with white ink with an anti-clogging solution. Accordingly, it is possible to prevent the nozzle row from being left uncontrolled over a long time while the nozzle row is filled with white ink. On the other hand, when the scheduled power OFF duration is shorter than one month which is the empirically obtained value as the time when the specific nozzle will become clogged, the power is cut OFF without filling the nozzle row with an anti-clogging solution. That is, since it is scheduled to be in a power ON state and execute a discharging operation before clogging is generated, the possibility of generating clogging is low even if the power is cut OFF without filling the nozzle row with an anti-clogging solution. Accordingly, it is possible to prevent the anti-clogging solution being unnecessarily expended.

As mentioned above, the printer 20 according to this embodiment includes the switch 56 which automatically switches the first filled state to the second filled state in accordance with a command from the system controller 51 when the predetermined condition is satisfied. Since the switch 56 automatically switches the first filled state to the second filled state, a user does not need to switch the state by hand. Therefore, even when the user is not near the printer 20, a nozzle row filled with white ink is automatically filled with an anti-clogging solution.

In the above-mentioned embodiment, it is described on the assumption that the printer is a so-called off-carriage type ink jet printer. However, the so-called on-carriage type ink jet printer may apply the embodiment of the invention. In this case, it is permissible that the printer is configured to notify a user to switch a cartridge containing white ink to a cartridge containing an anti-clogging solution in step S13 in FIG. 3 and in step S25 in FIG. 4. That is, it is permissible that the system controller 51 sends a command to display a message urging a user to replace a cartridge in the display (notifier) 55.

In this embodiment, the printer is configured to switch pigment-based white ink to an anti-clogging solution. However, it is not limited to pigment-based white ink, and it is possible to configure the printer to switch other ink to an anti-clogging solution. That is, it is permissible to switch ink which contains pigments, dyes, metal oxides, hollow resin particles, and the like to an anti-clogging solution.

EXAMPLE 1

Examples in which the printer 20 according to this embodiment is used will be described below.

A nozzle row filled with white ink was switched to be filled with an anti-clogging solution according to a flow chart shown in FIG. 4. The nozzle was placed at 40° C. for 2 months and after that, it was switched to fill the nozzle with white ink, thereby evaluating a nozzle failure evaluation and a curved flight evaluation.

The test results are shown in Table 1.

TABLE 1

| | | NOZZLE FAILURE | CURVED FLIGHT |
|---|---|---|---|
| Example 1 | Switch to anti-clogging solution<br>At 40° C. for 2 months later<br>Switch anti-clogging solution to White ink | A | A |
| Example 2 | Do not switch to anti-clogging solution<br>Left uncontrolled at 40° C. for 2 months later<br>Switch to anti-clogging solution, switch to white ink | B | B |
| Comparative Example 1 | Do not switch to anti-clogging solution<br>Left uncontrolled at 40° C. for 2 months later | C | C |

A nozzle failure indicates that droplets of ink are not discharged from a nozzle which is clogged. A curved flight indicates that droplets of ink are discharged from a nozzle row but the droplets of ink do not fly along the ideal trajectory and miss an ideal output location (referred to as an impact location).

Nozzle Failure Evaluating Criterion

A: No cleaning needed to return to an intact nozzle

B: 1 to 7 cleanings needed to return to an intact nozzle

C: 8 or more cleanings needed to return to an intact nozzle

Curved Flight Evaluating Criterion

A: No curved flight appeared

B: 1 to 3 spots of curved flight appeared

C: 3 or more spots of curved flight appeared

As shown in Table 1, in Example 1, both a nozzle failure evaluation and a curved flight evaluation were evaluated as A.

EXAMPLE 2

In Example 2, a nozzle row was left uncontrolled while the nozzle row was filled with white ink at 40° C. for 2 months. After that, white ink was switched to an anti-clogging solution and again switched to white ink according to a flow chart shown in FIG. 3, thereby evaluating a nozzle failure evaluation and a curved flight evaluation. Both a nozzle failure evaluation and a curved flight evaluation were evaluated as B.

COMPARATIVE EXAMPLE 1

In Comparative Example 1, without switching to an anti-clogging solution, a nozzle row was left uncontrolled while the nozzle row was filled with white ink at 40° C. for 2 months, thereby evaluating a nozzle failure evaluation and a curved flight evaluation. Both a nozzle failure evaluation and a curved flight evaluation were evaluated as C.

As mentioned above, it was identified that the printers 20 according to this embodiment in Examples 1 and 2 have better results on both a nozzle failure evaluation and a curved flight evaluation as compared to Comparative Example 1.

According to the known method, when white ink, which has a particle size bigger than that of other colored ink and readily causes clogging, is filled in a nozzle, it is necessary to replace the ink in an ink flow path by cleaning in order to prevent the nozzle from clogging and to secure an ink discharging stability. That is, when a method described in this embodiment is employed, the number of times for cleaning can certainly be decreased as shown in the above Examples. Accordingly, it is possible to decrease the amount of wasted ink and reduce the burdens on the environment.

What is claimed is:

1. A recording device for forming a printed image by discharging droplets of an image forming solution, which includes a white ink, from a plurality of nozzles and attaching the droplets on recording media, the recording device comprising:

a recording head provided with a specific nozzle of the plurality of nozzles which is selectively fillable with either the image forming solution or an anti-clogging solution that can prevent the specific nozzle from becoming clogged or from staying clogged, and a computer comprising a controller that controls the performance of switching from a first filled state in which the specific nozzle is filled with the image forming solution to a second filled state in which the specific nozzle is filled with the anti-clogging solution in a manner that can prevent the specific nozzle from either becoming clogged or from staying clogged, wherein the controller causes the specific nozzle to be supplied with the anti-clogging solution when the controller determines that power to the recording device has been OFF for a duration that is equal to or longer than a preset time, and the anti-clogging solution is used for the specific nozzle of the plurality of nozzles for the white ink.

2. The recording device according to claim 1, wherein predetermined condition indicates in the case that the controller causes the specific nozzle to be supplied with the anti-clogging solution when the controller determines that a duration of the first filled state is equal to or longer than a preset time.

3. The recording device according to claim 1, wherein the controller causes the specific nozzle to be supplied with the anti-clogging solution when a nozzle failure is detected by a discharging test from the specific nozzle and a duration of the first filled state is shorter than a preset time.

4. The recording device according to claim 1, comprising:

a switch which automatically switches from the first filled state to the second filled state in accordance with a command from the controller.

5. The recording device according to claim 1, comprising:

a carriage comprising a receptor which contains the image forming solution and another receptor which contains the anti-clogging solution, and a notifier which notifies a user of the recording device to replace the receptor with another receptor upon a command from the controller.

6. The recording device according to claim 1, wherein the image forming solution further includes a black ink, a cyan ink, a magenta ink and a yellow ink, the plurality of nozzles correspond to the white ink, the black ink, the cyan ink, the magenta ink and the yellow ink, respectively, and the anti-clogging solution is used only for the specific nozzle of the plurality of nozzles for the white ink and is not used for the other nozzles of the plurality of nozzles for the black ink, the cyan ink, the magenta ink and the yellow ink.

7. A method comprising the steps of:

(a) providing the recording device according to claim 1;

(b) determining in accordance with a condition programmed in the computer whether or not the specific nozzle should be filled with the anti-clogging solution to prevent the specific nozzle from becoming clogged or from staying clogged; and (c) if the determining in step (b) determines that the specific nozzle should be filled with the anti-clogging solution, switching from the first filled state in which the specific nozzle is filled with the image forming solution to the second filled state in which the specific nozzle is filled with the anti-clogging solution.

8. The recording device according to claim 1 comprising: an operation control program for causing the computer to cause a switch from the first filled state in which the specific nozzle is filled with the image forming solution to the second filled state in which the specific nozzle is filled with the anti-clogging solution.

9. A recording device for forming a printed image by discharging droplets of an image forming solution, which includes a white ink, from a plurality of nozzles and attaching the droplets on a recording medium, the recording device comprising:

(a) a recording head comprising a specific nozzle of the plurality of nozzles that can be selectively filled with either the image forming solution or an anti-clogging solution that can prevent the specific nozzle from becoming clogged or from staying clogged; and (b) means for controlling supply of the anti-clogging solution to the specific nozzle instead of the image forming solution in a case in which the anti-clogging solution can effectively prevent the specific nozzle from becoming clogged or from staying clogged, wherein the means causes the anti-clogging solution to be supplied to the specific nozzle when power to the recording device has been off for a period of time that is equal to or longer than a preset time, and the anti-clogging solution is used for the specific nozzle for the white ink.

10. The recording device according to claim 9, wherein the means causes the anti-clogging solution to be supplied to the specific nozzle when the specific nozzle has been filled with the image forming solution for a period of time that is equal to or longer than a preset time.

11. The recording device according to claim 9, wherein the means causes the anti-clogging solution to be supplied to the specific nozzle when a failure of the specific nozzle is detected.

12. The recording device according to claim 9, wherein the recording device comprises a first receptor for the image forming solution and a second receptor for the anti-clogging solution and the means comprises a switch for switching a liquid supply path to the specific nozzle from a first path between the first receptor and the specific nozzle to a second path between the second receptor and the specific nozzle.

13. The recording device according to claim 9, wherein the first receptor comprises image forming solution and the second receptor comprises anti-clogging solution.

14. The recording device according to claim 9, comprising:

(a) a carriage comprising a first receptor which contains the image forming solution and a second receptor which contains the anti-clogging solution; and (b) a display which notifies a user of the recording device to replace the first receptor with another receptor.

15. The recording device according to claim 9, which comprises a first receptor for the image forming solution and a second receptor for the anti-clogging solution, wherein each of the first and second receptors is operationally connected for supplying the image forming solution or the anti-clogging solution from the first or second receptor to the specific nozzle only.

16. The recording device according to claim 15, comprising a switch for switching a supply path to the specific nozzle from a first path between the first receptor and the specific nozzle and a second path between the second receptor and the specific nozzle.

17. The recording device according to claim 9, wherein the means exercises control to prevent the specific nozzle from clogging.

18. The recording device according to claim 9, wherein the means exercises control to prevent the specific nozzle from staying clogged.

19. The recording device according to claim 9, wherein the image forming solution further includes a black ink, a cyan ink, a magenta ink and a yellow ink, the plurality of nozzles correspond to the white ink, the black ink, the cyan ink, the magenta ink and the yellow ink, respectively, and the anti-clogging solution is used only for the specific nozzle of the plurality of nozzles for the white ink and is not used for the other nozzles of the plurality of nozzles for the black ink, the cyan ink, the magenta ink and the yellow ink.

20. A recording device for forming a printed image by discharging droplets of an image forming solution, which includes a white ink, from a plurality of nozzles and attaching the droplets on recording media, the recording device comprising:

a recording head provided with a specific nozzle of the plurality of nozzles which is selectively fillable with either the image forming solution or an anti-clogging solution that can prevent the specific nozzle from becoming clogged or from staying clogged, and a computer comprising a controller that controls the performance of switching from a first filled state in which the specific nozzle is filled with the image forming solution to a second filled state in which the specific nozzle is filled with the anti-clogging solution in a manner that can prevent the specific nozzle from either becoming clogged or from staying clogged, wherein the controller causes the specific nozzle to be supplied with the anti-clogging solution when the controller determines that a duration of the first filled state is equal to or longer than a preset time, and wherein the controller can change the preset time if a change in conditions warrant that the anti-clogging solution be supplied to the specific nozzle at a different time interval, and the anti-clogging solution is used for the specific nozzle for the white ink.

21. The recording device according to claim 20, wherein the controller causes the specific nozzle to be supplied with the anti-clogging solution when a nozzle failure is detected by a discharging test from the specific nozzle and a duration of the first filled state is shorter than the preset time.

22. The recording device according to claim 20, wherein the controller causes the specific nozzle to be supplied with the anti-clogging solution when the controller determines that power to the recording device has been OFF for a duration that is equal to or longer than a preset time.

23. A recording device for forming a printed image by discharging droplets of an image forming solution, which includes a plurality of colored inks, from a plurality of nozzles and attaching the droplets on recording media, the recording device comprising:

a recording head provided with a specific nozzle of the plurality of nozzles which is selectively fillable with either the image forming solution or an anti-clogging solution that can prevent the specific nozzle from becoming clogged or from staying clogged; and a computer comprising a controller that controls performance of switching from a first filled state in which the specific nozzle is filled with the image forming solution to a second filled state in which the specific nozzle is filled with the anti-clogging solution in a manner that can prevent the specific nozzle from either becoming clogged or from staying clogged, wherein the anti-clogging solution is used for the specific nozzle for one of the plurality of colored inks that has a pigment diameter greater than 100 nm.

24. The recording device according to claim 23, wherein the plurality of colored inks are at least a white ink, a black ink, a cyan ink, a magenta ink and a yellow ink, the plurality of nozzles correspond to the plurality of colored inks, respectively, and the anti-clogging solution is used only for the specific nozzle of the plurality of nozzles for the white ink and is not used for the other nozzles of the plurality of nozzles for the black ink, the cyan ink, the magenta ink and the yellow ink.

* * * * *